US005279104A

United States Patent [19]

Mayer et al.

[11] Patent Number: 5,279,104

[45] Date of Patent: Jan. 18, 1994

[54] PROCESS AND DEVICE FOR THE PIECING OF AN OPEN-END SPINNING DEVICE

[75] Inventors: Walter Mayer, Ingolstadt; Johann Halbritter, Wettstetten, both of Fed. Rep. of Germany

[73] Assignee: Schubert & Salzer Maschinenfabrik AG, Ingolstadt, Fed. Rep. of Germany

[21] Appl. No.: 881,708

[22] Filed: May 12, 1992

[30] Foreign Application Priority Data

May 11, 1991 [DE] Fed. Rep. of Germany ..... 4115444

[51] Int. Cl.[5] ..... D01H 4/50

[52] U.S. Cl. ..... 57/263; 57/264

[58] Field of Search ..... 57/261, 263, 262, 22, 57/264, 266, 268, 269, 270, 276, 278

[56] References Cited

U.S. PATENT DOCUMENTS

| | | | |
|---|---|---|---|
| 4,494,371 | 1/1985 | Morita et al. | 57/263 |
| 4,644,742 | 2/1987 | Lovas et al. | 57/263 |
| 4,920,739 | 5/1990 | Rausch | 57/263 |
| 5,022,222 | 6/1991 | Rupert et al. | 57/263 |
| 5,083,420 | 1/1992 | Rupert et al. | 57/263 |
| 5,159,804 | 11/1992 | Schippers et al. | 57/263 X |

FOREIGN PATENT DOCUMENTS 3202428 8/1983 Fed. Rep. of Germany .

*Primary Examiner*—Clifford D. Crowder
*Assistant Examiner*—Larry D. Worrell, Jr.
*Attorney, Agent, or Firm*—Dority & Manning

[57] ABSTRACT

A process for the piecing of a yarn end on a open-end spinning machine. The yarn is backfed a first time from a cross-wound package, the backfeeding is interrupted and the yarn is clamped at a predetermined distance from the package and the free end is cut. The backfeeding is then resumed for a predetermined period of time and the yarn is temporarily stored between the clamping point and the package. The stored yarn is then wound onto the package in a plurality of parallel windings upon a predetermined generating line. The yarn clamp is released to backfeed the yarn remaining in the temporary storage device and to stretch or tension the yarn between the package and the backfeeding means. The yarn is reclamped and the excess yarn is cut to a predetermined length. The yarn is backfed to the spinning rotor of the open-end spinning machine to combine with fibers in the rotor to piece up the yarn, which is then drawn off the rotor and wound onto the package. The invention also includes apparatus for carrying out the method.

24 Claims, 2 Drawing Sheets

PROCESS AND DEVICE FOR THE PIECING OF AN OPEN-END SPINNING DEVICE

BACKGROUND OF THE INVENTION

The instant invention relates to a process for piecing an open-end spinning device in which a yarn is fed back from a cross-wound package a first time, is then re-wound on a predetermined generating line of the cross-wound package in the form of parallel windings and is finally fed back from these parallel windings for a second time to an open-end spinning element. It is then cut to a predetermined length and the cut yarn is back-fed to combine with the newly fed fibers and is finally continuously drawn off in form of a yarn with incorporated fibers, as well as a device to carry out this process.

In a known process the yarn is stored by means of the suction pipe which sucks the yarn away from the cross-wound package, and from this store it is again wound up on the cross-wound package while parallel windings are formed (U.S. Pat. No. 4,494,371). In such a swivelling suction pipe which has, furthermore, the task of presenting the yarn to a transfer element for transfer to the spinning element, the yarn must, however, be deflected several times, and this makes it more difficult to draw the yarn off again to constitute parallel windings on the cross-wound package. In addition the yarn's surface is affected as it is pulled over deflection points. By retaining the yarn end in the suction pipe during re-winding of the yarn to constitute parallel windings on the cross-wound package, the yarn is stretched to varying degrees, depending on the material and yarn thickness, due to the yarn tension which then occurs, leading to imprecision in yarn length. In addition the increased yarn tension leads to constrictions on the package which cause problems in the process. These process problems occur during back-feeding for piecing as well as in the further processing of the yarn, as the yarn length wound up in form of parallel windings exceeds the yarn length needed for piecing for reasons of security, so that a short yarn length of yarn, representing a remainder of the parallel windings, remains on the cross-wound package after piecing.

SUMMARY OF THE INVENTION

It is therefore the object of the instant invention to create a process and a device making it possible in a simple manner, to size the yarn to be fed back with precision by means of the winding mechanism.

This object is attained through the invention in that the first back-feeding of the yarn for yarn cutting is interrupted, the yarn fed back from the cross-wound package is clamped at a distance of the cross-wound package and the back-feeding of the yarn is continued for a predetermined time span. The yarn is put in temporary storage between the cross-wound package and the clamping point in that it is again wound up on a predetermined generating line of the cross-wound package for a maximum period of time equal to that necessary for back-feeding during piecing. Clamping is then stopped and the remaining yarn in storage is withdrawn and stretched before it is cut to its defined length and is fed back to the spinning element. By continuing back-feeding the yarn after it has been clamped and by providing for temporary storage of the yarn between the cross-wound package and the clamping point a yarn reserve is created which can be easily dissolved later and can be wound up on the cross-wound package.

During its temporary storage the yarn is held pneumatically in form of a yarn loop. Mechanical retention forces appear only at the outlet of the yarn storage, so that their effect can be disregarded as the yarn loop is dissolved. No different yarn tensions occur as the yarn is wound up in parallel windings so that unwanted length variations of the wound-up yarn segment are avoided. The yarn length wound up on a predetermined generating line of the cross-wound package is now known and defined so that this precisely measured and defined yarn length is available during a subsequent back-feeding for piecing. Since the yarn is wound up on a predetermined generating line of the cross-wound package as it is again wound up before back-feeding for piecing, the wound-up yarn length is shorter than the yarn length which had been wound on the cross-wound package in cross-winding. The excess of yarn which remains in the temporary storage is released by stopping clamping and by the stretching of the yarn. The yarn is cut to size after the excess yarn is removed from the temporary storage. In this manner the yarn is measured out so that it can be fed back, on the one hand, in a precise predetermined length from the open-end spinning element while, on the other hand, at the moment of resumption of yarn draw-off, no additional yarn reserve is provided between the open-end spinning element and the cross-wound package. Yarn draw-off is thus resumed without delay as soon as the cross-wound package is driven in the winding direction. Since the point at which the yarn is wound on the package is always located at a location of the cross-wound package that is determined by the predetermined generating line, the beginning of yarn draw-off is also defined precisely.

In order to simplify programming as much as possible, identical times are advantageously chosen according to the invention for the continuation of the first back-feeding of the yarn after onset of clamping and subsequent winding of the yarn on a predetermined generating line of the cross-wound package.

When different back-feeding and winding speeds are provided, the driving speed of the cross-wound package is appropriately taken into consideration when selecting the times for continuation of the first back-feeding after onset of clamping and subsequent winding of the yarn.

Since the circumference ratio between the small diameter of a conical cross-wound package and its large diameter, changes as the diameter of the cross-wound package increases, the length of yarn fed back from the conical cross-wound package also changes. For this reason it is advisable to take the mean diameter of the conical cross-wound package into consideration when selecting the times for continuing the first back-feeding after onset of clamping and the subsequent winding of the yarn.

In order to avoid having to set new times each time the drive speed of the cross-wound package is changed and/or when the mean diameter of a cross-wound package changes in course of winding it is advantageous to set the times in function of maximum possible drive speed of the cross-wound package and/or the minimum possible mean diameter of a conical cross-wound package.

When the yarn is fed back for piecing, short yarn lengths originating in the cross-winding range of cross-wound package winding may possibly be tolerated as part of the overall back-feeding for piecing. A very precise sizing of the yarn length to be fed back is however preferable in every case. Such precise sizing is achieved according to the invention in that the times for the continuation of the first back-feeding of the yarn after onset of clamping and for the subsequent winding of the yarn are determined in such a manner that the yarn length conveyed during those times is greater than the yarn length conveyed for the second back-feeding to the open-end spinning element.

In principle it does not matter in which area of the cross-wound package the yarn provided for piecing is wound up. However, since the circumference of the cross-wound package changes over its width, especially in conical cross-wound packages, the length of yarn fed back does not always match the length of the perimeter at which the cross-wound package is being driven during this yarn back-feeding. To avoid the need for conversion calculations by a control device, the cross-wound package is preferably driven at its perimeter while the yarn segment to be then again fed back is wound up in the area of the cross-wound package's drive.

In principle, the yarn can be stretched by a mechanical draw-off device working with slippage, but it has been shown to be especially advantageous for stretching to be effected by pneumatic means.

To carry out the process the invention provides for a yarn storage in the path of the yarn, between the yarn guide and the clamping device located between the cross-wound package and the yarn delivery device, while the driving device of the winding device is provided with a timing element to rotate the cross-wound package backwards and for subsequent re-winding of the yarn being guided by the yarn guide.

To avoid a mechanical retention effect upon the yarn at the outlet of the yarn storage, an advantageous embodiment of the invention provides for the yarn storage to extend essentially in continuation of the path of the yarn segment extending from the side away from the clamping device into the yarn storage area.

For the sake of simplified design of the object of the invention, the pneumatic yarn storage can be controlled in a suitable manner.

In order to easily ensure that the piecing yarn length readied on the cross-wound package is exactly equal to the calculated value, the invention advantageously provides for the driving device to be brought to bear on the perimeter of the cross-wound package and for the yarn guide to be located within range of the width of cross-wound package at which it is driven by the driving device. In principle, different designs are possible for the yarn guide. However a design where the yarn guide is made in form of a threaded spindle capable of being driven at will in one or the other direction of rotation and with two longitudinal segments with opposing threads offset in diameter and with a peripheral groove at the point between the two length segments has been proven to be especially advantageous. This threaded spindle centers the yarn in the peripheral groove as it is driven in one direction so that the yarn can be wound up at a given generating line of the cross-wound package. To be able to throw off the yarn later on from the threaded spindle in order to release it again, the threaded spindle need only be driven in the opposite direction.

In order to easily establish the yarn length to be readied for piecing, the timing mechanism provided for the driving device of the winding mechanism is advantageously designed to determine the yarn back-feed time and a time of equal length for re-winding of the yarn.

To be able to take into account different speeds of the cross-wound package in preparing the yarn segment provided for piecing, another advantageous embodiment of the invention provides for the speed of the driving device to be controlled by a control device with which the timing mechanism is connected for control.

Similarly, a detection device, connected for control purposes to the control device, can be provided for the ascertainment of the mean diameter of a cross-wound package that is present in the winding device can be provided to compensate for different diameters of a conical cross-wound package and thereby for the different ratios between the circumference at the smallest and at the largest diameter of this conical cross-wound package.

In an advantageous process the yarn required for piecing is fed back from a piecing storage which is located according to the invention between the winding device in its piecing position and the clamping device in it piecing position in order to store the yarn fed back during the continuation of the first back-feeding. The clamping device is in the form of a pair of rollers that can be assigned to the open-end spinning device and can be opened at the latest after the piecing storage has been filled. As the yarn is fed back for piecing, the piecing storage is emptied completely, so that the piecing draw-off can be effected by the cross-wound package.

In another also advantageous embodiment of the invention, the clamping device is made in the form of a pair of rollers which can be assigned to the open-end spinning device and can be opened before the beginning of further back-feeding of the yarn to the open-end spinning element.

Different designs are also possible for the yarn delivery device, but it has been shown that a pneumatic yarn delivery device is especially advantageous.

The object of the invention can be used in particular in combination with a draw-off effected by means of the cross-wound package, but it is not limited to such a device. The sizing of the yarn end to be fed back can, for instance, be effected by means of the present object of the invention, whereupon back-feeding for piecing and piecing draw-off can be effected by means of a pair of rollers, possibly constituted by the above-described clamping device.

The invention is simple in design and reliable in its operation and makes it possible to size the yarn length precisely, even when different fiber materials are being used or different yarn numbers are being produced. This ensures optimal piecing conditions and unobtrusive but reliable piecing joints.

Examples of embodiments of the invention are explained in further detail through the accompanying drawings in which

BRIEF DESCRIPTION OF THE INVENTION

FIG. 1 is a side view in schematic form of an open-end spinning device according to the invention; and FIG. 2 is a front view of the device shown in FIG. 1.

DESCRIPTION OF A PREFERRED EMBODIMENT

In the two figures, through which the invention is explained below, only the essential elements of an open-end spinning device functioning according to the open-end spinning process which are necessary to understand the invention are represented. These elements are as a rule and in practice distributed among the open-end spinning machine 1 and a service unit 2 travelling alongside the machine, but it is also possible to provide all of the shown elements on the open-end spinning machine itself and to dispense with the service unit 2, in particular in testing machines with one or only a few spinning stations.

Figure 1:
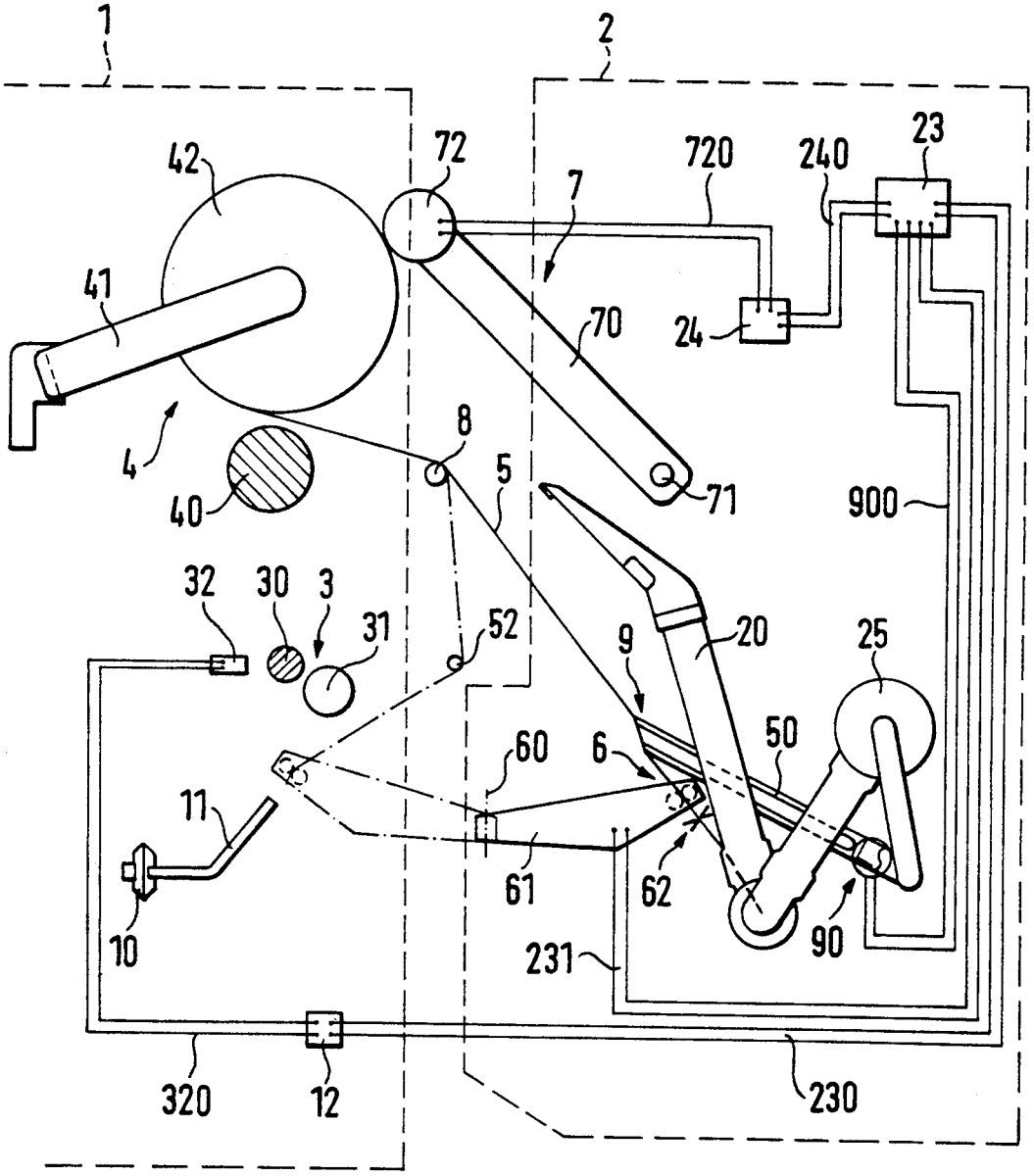

The open-end spinning machine 1 has a plurality of spinning stations of which, however, only one is shown in FIG. 1. One open-end spinning device with a spinning element 10, e.g. a spinning rotor in a housing (now shown), a draw-off roller pair 3 and a winding device 4 are provided per spinning station.

A fiber sliver is fed by conventional means in a known manner to the spinning element 10 and is then opened into individual fibers which are spun into a yarn 5 in the spinning element 10. The yarn 5 leaves the spinning element 10 through a yarn draw-off pipe 11.

The draw-off roller pair 3 is equipped with a driven draw-off roller 30 and a pressure roller 31 which is applied during production operation against the draw-off roller 30 and is driven by it, but which can be lifted off the draw-off roller 30 for piecing.

The drive of the draw-off roller pair 3 is provided at a suitable location with a scanning device 32 which records the number of revolutions and transmits corresponding counting signals via a control circuit 320 to a control device 12.

The winding device 4 consists essentially of a winding roller 40 on which a cross-wound package 42 held between two package arms 41 is applied during normal production operation.

In the path of the yarn, between the spinning element 10 and the winding device 4, the usual yarn monitors, tension compensation means and a traversing yarn guide are, of course, provided, but they are not shown for the sake of clarity of the drawing. Also for the sake of clarity, a package lifting element which lifts the cross-wound package 42 from the winding roller 40 when a yarn breakage occurs has been left out.

A swivelling suction pipe 20 is located on the service unit 2, it being possible to move said suction pipe to the underside of the cross-wound package 42 lifted off the winding roller 40 so as to be able to take up the end of a torn yarn 5. The suction pipe 20 which constitutes a yarn delivery device is elbow-shaped and is provided with a longitudinal slit 21 (FIG. 2) on its side towards the open-end spinning machine 1 so that the yarn 5, as it increasingly enters the suction pipe 20, is able to leave partially through this longitudinal slit 21 in form of a filament.

The service unit 2, furthermore, carries an auxiliary roller pair 6 serving as a clamping device which is supported by an arm 61 capable of swivelling around an axle 60 in such manner that the auxiliary roller pair 6 can grasp the filament-like yarn 5 extending from the cross-wound package 42 into the suction pipe 20 and can convey it to the yarn draw-off pipe 11.

In addition a auxiliary package drive 7 for the cross-wound package 42 is provided on the service unit 2. The auxiliary package drive 7 has a swivel arm 70 mounted pivotably on an axle 71 and supporting an auxiliary drive roller 72 on its free end which can be brought from a rest position (not shown) into a position pressing against the cross-wound package 42 and which can be driven at will in one or the other direction by a drive (not shown) in a manner not shown here.

Furthermore, means (not shown) to support the package arms 41 are provided on the service unit 2 so as to be able to hold the cross-wound package 42 while it is being driven by the auxiliary drive roller 72 at a defined distance from the winding roller 40.

A centering device 8 mounted on the service unit 2 and capable of being brought from the shown working position into a rest position is placed during the piecing process in the path of the yarn, between the winding device 4 and the end 22 of the longitudinal slit 21 of the suction pipe 20. The centering device 8 in the embodiment shown is a threaded spindle with two longitudinal sections 80 and 81, of which the section 80 towards the support 82 has a greater diameter than the longitudinal section 81 away from the support 82. The threads of the two longitudinal sections 80 and 81 have opposite pitches. At the transition point between the two longitudinal sections 80 and 81 a circumferential groove 83 is furthermore located.

Figure 2:
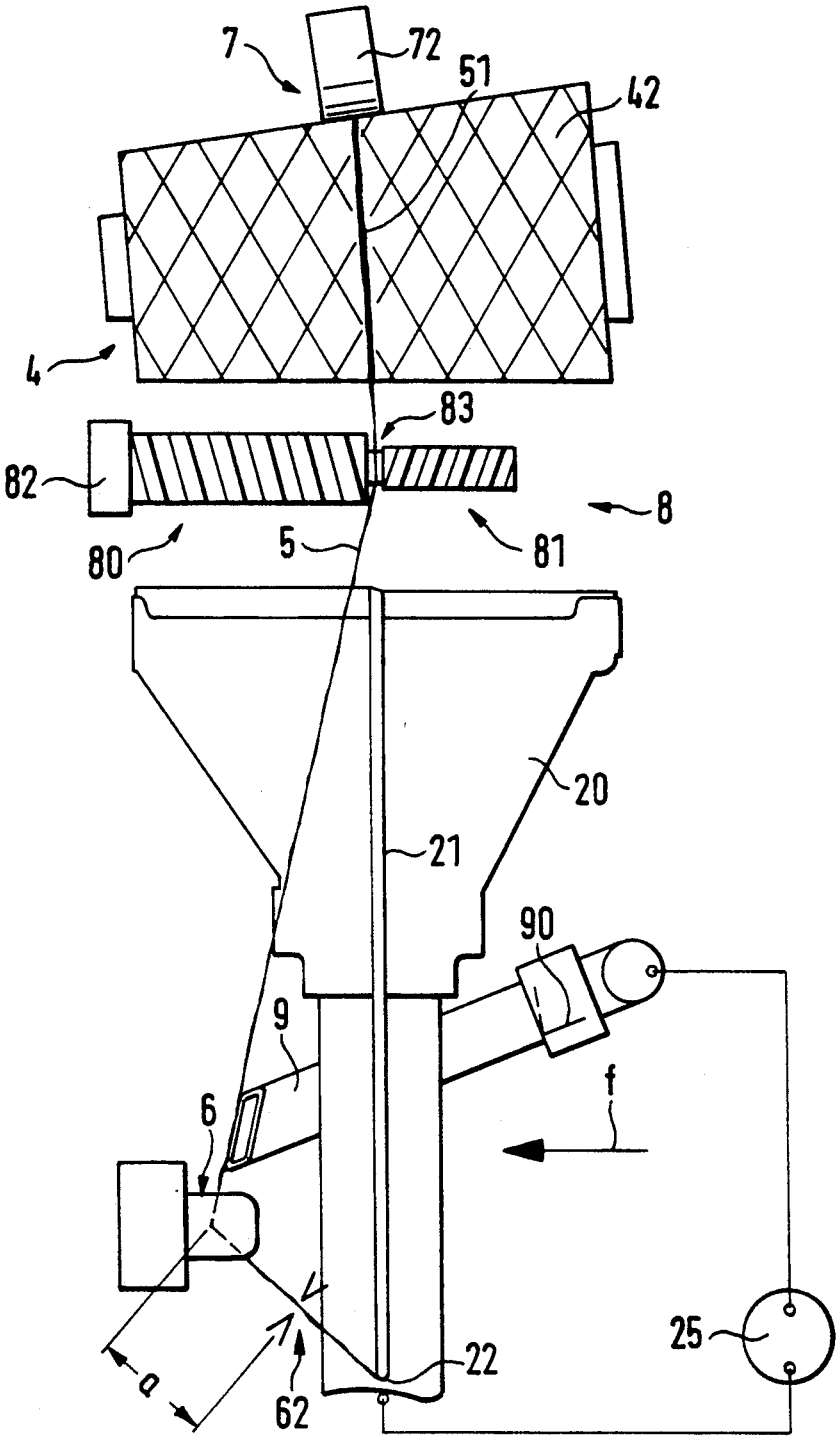

In addition, a yarn storage 9 is located which serves as a yarn guide to align the yarn 5 for it to be taken up by the auxiliary roller pari 6 and the align the yarn 5 with respect to the cross-wound package 42 in relation to the package width between the centering device 8 and the auxiliary roller pair 6. In FIG. 2 the direction of movement of the auxiliary roller pair 6 from the rest position into the work position above the outlet of the yarn draw-off pipe 11 is indicated by an arrow f. As FIG. 2 makes apparent, the yarn storage 9 is located next to the suction pipe 20 on its side passed by the auxiliary roller pair 6 after take-up of the yarn 5. In this manner the outlet of the yarn storage is placed in immediate proximity of the course of the yarn 5 extending from the yarn guide (circumferential groove 83 of the centering device 8) to the clamping device constituted by the auxiliary roller pair 6 which take up the position next to the suction pipe 20. The suction pipe 20 as well as the yarn storage 9 are connected to a common suction circuit 25.

Between the auxiliary roller pair 6, which constitutes a clamping device in the area of the yarn storage 9 and the end 22 of the longitudinal slit 21 of the suction pipe 20 which is part of the above-mentioned delivery device, a controlled cutting device 62 is located at a defined distance a from the auxiliary roller pair 6.

To control the spinning process, a control device 23 connected to those elements of the service unit 2 which become active in the piecing process is provided on the service unit 2. For the sake of clarity, FIG. 1 shows only those control connections which are especially important for the explanation. Thus for instance the control device 23 is connected via a control circuit 240 to a timing unit 24 which is in turn connected via a control circuit 720 to the auxiliary drive roller 72.

A valve 90 is provided in this suction circuit of the yarn storage 9 and is in turn also connected via a control circuit 900 to the control device 23.

The control device 23 is furthermore connected via a control circuit 231 to the drive and to the clamping control of the auxiliary roller pair 6 as well as via a control circuit 230 to the control device 12 of the machine.

The device described above with respect to its construction functions as follows:

During normal spinning, a fiber sliver opened into individual fibers (not shown) is fed to the open-end spinning element 10 and combines in the spinning element 10 with the end of a yarn 5 which is drawn off continuously through a yarn draw-off pipe 11 from the spinning element 10 by means of the pair of draw-off rollers 3 and is wound up in cross-winding on the cross-wound package 42 by means of a traversing yarn guide, the cross-wound package 42 pressing in turn on the winding roller 40 and thus being driven by the same at a constant circumferential speed.

When a yarn breakage occurs, it triggers via a yarn monitor (not shown) the termination of fiber feed to the spinning element 10 and a lifting of the cross-wound package 42 from the winding roller 40. The winding of the yarn 5 on the cross-wound package 42 is stopped very quickly in this manner, under certain conditions even before the yarn end has reached the cross-wound package 42. The above-mentioned yarn monitor triggers a signal in a known manner, either calling up the service unit 2 via control device 12 or causing the constantly circulating service unit 2 to stop at the failed spinning station in order to repair the yarn breakage.

When the service unit 2 has assumed its operating position at the affected spinning station, the control device 23 temporarily switches on a cleaning device (not shown) for the spinning element 10 so that fibers and dirt particles in or on the same are removed from it. Furthermore, the pressure roller 31 is lifted by the service unit 2 from the driven draw-off roller 30 in a manner not shown here. In addition, a supporting device, acting upon the package arms 41 and not shown here, holds the cross-wound package 42 in a lifted position under the control of the service unit 2 so that the cross-wound package 42 is not pressed against the winding roller 40, while the package lifting device on the machine (not shown) which has become active with the occurrence of yarn breakage returns into its rest position. This support of the cross-wound package 42 under the control of the service unit 2 liberates the cross-wound package 42 so that it is freely rotatable.

The control device 23 now acts in a manner not shown here upon the driving device (not shown) of the suction pipe 20, causing it to be brought into yarn receiving position near the perimeter of the cross-wound package 42. Furthermore, the control device 23 causes the swivel arm 70 of the auxiliary package drive 7 to be swivelled towards the cross-wound package 42 until the auxiliary driving roller 72 is pressed against the perimeter of the cross-wound package 42. The auxiliary driving roller 72 is now driven in back-feeding direction under control of the control device 23 via control circuit 720. At the same time an underpressure or vacuum is created in the suction pipe 20. In this manner the suction pipe 20 is able to take up the broken end of yarn 5 from the cross-wound package 42 and suck it away. When a predetermined length has been sucked into the suction pipe 20, sufficient for the yarn 5 to be held securely by the underpressure and the deflection in the suction pipe 20, the suction pipe 20 is brought from its receiving position near the perimeter of the cross-wound package 42 into the rest position shown in FIG. 1, in which an intermediate segment of the yarn 5 leaves the longitudinal slit 21 of the suction pipe 20. The yarn end is furthermore held securely in the suction pipe 20 thanks to the suction effect and because it is being pressed against the deflection edge.

The suction pipe 20 and the auxiliary package drive 7 of the cross-wound package 42 thus constitute together a yarn back-feeding device to back-feed the yarn 5 from the cross-wound package 42.

Shortly after withdrawal of the suction pipe 20, the centering device 8 is taken out of its rest position (not shown) into its operating position shown in FIG. 1, so that the yarn 5 emerging from the longitudinal slit 21 of the suction pipe 20 comes to lie on the centering device 8. The yarn 5 extending from the cross-wound package 42 via the centering device 8 to the yarn delivery device (end of the longitudinal slit 21 of the suction pipe 20) thus either reaches the longitudinal section 80 or the longitudinal section 81, depending on whether the yarn extends towards the right or the left end of the package.

The auxiliary driving roller 72 is now stopped so that the back-feeding of the yarn into the suction pipe 20 is interrupted. The centering device 8 in form of a threaded spindle is now driven in such manner that the yarn 5 is conveyed through the threads of one of the two longitudinal sections 80 or 81 into the circumferential groove 83.

When the yarn 5 is in the circumferential groove 83 it assumes a defined or predetermined position between the centering device 8 and the end 22 of the longitudinal slit 21. Now the auxiliary roller pair 6 which is at first in a rest position on the right side of the suction pipe 20 (ref. FIG. 2) is brought into a receiving position in which the open rollers of the auxiliary roller pair 6 are able to take up the yarn 5. The auxiliary roller pair 6 is now moved on in direction of arrow f and into the position shown in FIG. 2, in which the yarn section between the circumferential groove 83 of the centering device 8 and the auxiliary roller pair 6 is located in proximity of the outlet of the yarn storage 9, and is closed now at the latest. If desired, the auxiliary roller pair 6 can however be closed immediately upon taking up the yarn. In any case, by designing or controlling the auxiliary roller pair 6 in a suitable manner, or by assigning it a yarn carrier (not shown), it is possible to ensure that the yarn 5 is brought in front of the outlet of the yarn storage 9 as the auxiliary roller pair 6 moves.

The auxiliary roller pair 6 is in a clamped state. Back-feeding of the yarn by the cross-wound package 42 which is again being driven by the auxiliary driving roller 72 is resumed, with the yarn 5 no longer being able to enter the suction pipe 20 because it is clamped by the auxiliary roller pair 6. Instead, yarn 5 goes into the yarn storage 9 where it constitutes a yarn loop 50 (FIG. 1).

When a yarn length that is in any case sufficient for subsequent back-feeding for piecing has been delivered into the yarn storage 9, the auxiliary driving roller 72 is stopped and thereby the back-feeding of the yarn 5 into the yarn storage 9 is also stopped. The auxiliary driving roller 72 is now driven at the same speed as previously for unwinding, but in the opposite direction, whereby the yarn 5 is wound up on a defined generating line of the cross-wound package 42 in form of parallel yarn windings 51 as a result of being guided by the centering device 8. The placement of the centering device 8 is such that the forming yarn windings 51 are in the drive zone of the cross-wound package 42, i.e. within the area in which the auxiliary driving roller 72 is pressed against the perimeter of the cross-wound package 42. This has the advantage that the yarn length to be fed back is determined directly by the length of the circumference of the auxiliary driving roller 72, without calculation and independent of the package diameter.

The timing element 24 which is provided between the control device 23 and the auxiliary driving roller 72 causes the back-feeding time for the back-feeding of the yarn 5 into the yarn storage 9 through backward rotation of the cross-wound package 42 as well as the winding time for subsequent draw-off of the yarn 5 from the yarn storage 9 and its winding on a defined generating line of the cross-wound package 42 to be adjusted and controlled in such manner that the winding time is as a rule shorter than the prior unwinding time. Under certain circumstances which shall be explained in further detail, both times may also be equal.

Since the yarn 5 fed back into the yarn storage 9 had previously been cross-wound on the cross-wound package 42, while the yarn 5 newly wound up on the cross-wound package 42 for piecing constitutes parallel yarn windings 51 along a generating line of the cross-wound package 42, or because of the times selected for unwinding and winding, the rewound yarn length is shorter than the yarn length previously fed back into the yarn storage 9. For this reason the clamping action of the auxiliary roller pair 6 is now temporarily halted so that the underpressure prevailing in the suction pipe 20 is again able to pull the remaining yarn out of the yarn storage 9 and is thus able to stretch the yarn 5. If necessary, the underpressure in the yarn storage 9 is switched off for this by means of valve 90, so that only the underpressure prevailing in the suction pipe 20 takes effect.

The auxiliary roller pair 6 is closed again, so that the yarn 5 is again clamped. The cutting device 62 which is located at a defined distance a below the auxiliary roller pair 6, i.e. between auxiliary roller pair 6 and the end 22 of the longitudinal slit 21, now cuts the yarn 5 so that the length of said yarn 5 up to the cross-wound package 42 is defined exactly by this cutting device 62 since the yarn 5 follows a course that is determined precisely with respect to course and length by the auxiliary roller pair 6, the centering device 8 and the generating line of the cross-wound package 42 on which the yarn windings 51 have been constituted.

The yarn end is now brought into its piecing position in front of the outlet of the yarn draw-off pipe 11 by swivelling the auxiliary roller pair 6, whereby the yarn end can of course be prepared in a known manner and in the customary manner for piecing. The yarn 5 can be fed back to the spinning element from this position, and for this the auxiliary roller pair 6 is opened. This back-feeding of the yarn 5 from the cross-wound package 42 is now started, it being possible to back-feed the yarn 5 directly into the yarn draw-off pipe 11 up to the collection surface of the spinning element 10, depending on the piecing process used.

As an alternative it is of course also possible to take the yarn 5 from the parallel yarn windings 51 into a readiness position (not shown) within the yarn draw-off pipe 11 and constitute a yarn reserve from the remaining, back-fed yarn 5 by means of a yarn deflection element 52 (FIG. 1) The yarn deflection element 52 which constitutes a piecing reserve is located between the winding device 4 and the auxiliary roller pair 6 which assumes the piecing position.

Further back-feeding of the yarn 5 for piecing takes place later, after opening of the auxiliary roller pair 6 by throwing off the yarn from the yarn deflection element 52. Back-feeding for piecing is effected in this case by releasing the yarn reserve which was however formed previously from the parallel windings 51 on the cross-wound package 42.

In both cases the yarn length fed back directly or indirectly (with intercalation of a yarn reserve serving as a piecing storage), is determined directly by the number of revolutions for which the cross-wound package 42 is driven by the auxiliary driving roller 72 in direction of back-feed. If, as mentioned earlier, the yarn 5 is here wound up in form of yarn windings 51 in the driving area of the cross-wound package 42, the back-fed piecing length is derived directly, without conversion, from the length of the circumference by which the auxiliary drive roller 72 was turned back. The yarn segment reaching the fiber collection surface of the spinning elements 10 during back-feeding for piecing is thus always identical in length and does not depend on the size or shape of the cross-wound package 42 nor on the location where the back-fed yarn segment was originally wound up on the cross-wound package 42. As a result piecing is substantially optimized with respect to piecing reliability as well as piecing quality, i.e. uniformity of piecing joints, since thick or thin places such as were caused until now by undefined yarn back-feed lengths are avoided.

The scanning device 32 together with the control device 12 of the open-end spinning machine 1 and the control device 23 of the service unit 2 constitute a detection device to ascertain the mean diameter of a cross-wound package 42 which is in the winding device 4. For this purpose the signals which are proportional to the number of revolutions of the draw-off roller 30 or of another part rotating at the determined ratio thereto are counted in the control device 12 of the machine. Counting is interrupted when the yarn monitor (not shown) of the spinning station concerned registers a yarn breakage and is resumed when such a yarn breakage has been repaired, an event that is signalled by the control device 23 of the control device 12. Similarly the control device 23 informs the control device 12 by signal when a package replacement takes place, so that the counting mechanism in the control device 12 is reset to zero. In this manner a value that is proportional to the number of revolutions of the draw-off roller 30 in an uninterrupted spinning process and thereby also proportional to the wound-up yarn length is always stored in the control device 12. The package size and thereby the package diameter and, in the case of conical cross-wound packages 42 also their mean diameter then results from this yarn length while taking into consideration yarn number, winding tension, etc.

Since the diameter ratio between small and large diameter changes with different diameters of conical cross-wound packages 42, this must be taken into account in determining the times for back-feeding of yarn 5 into the yarn storage 9, and this is done by means of a suitable manual or automatic adjustment of the time element 24. More details shall be given further on.

In the embodiment described above the time element 24 provides for identical times for back-feeding of the yarn 5 into the yarn storage 9 and for renewed winding of the yarn 5 to constitute parallel yarn windings 51. This is especially useful since entering different times in the program would render piecing very difficult, especially since it would then not be absolutely certain that the yarn lengths put in temporary storage in the yarn storage 9 would be sufficient to constitute parallel yarn windings 51. However, if the times for the filling and emptying of the yarn storage 9 are selected so as to be identical, a yarn remnant remains in any case in the yarn storage 9 upon completion of intermediate winding of the yarn on the cross-wound package 42 since the length of the traversingly unwound yarn 5 is certain to be greater than the yarn length wound up for the same period of time if the unwinding speed and the winding speed are identical and providing that the yarn length of one or several complete cross-windings has been stored in the yarn storage 9. In any case the times for the continuation of the first back-feeding of the yarn 5 after onset of clamping by the auxiliary roller pair 6 must be determined for the initiation of temporary storage as well as for the parallel intermediate winding on the cross-wound package 42 in such manner that the yarn section conveyed thereby, and thereby readied, is longer than the yarn section which will be needed later for back-feeding to the spinning element 10 for piecing.

The times for the back-feeding of the yarn 5 into the yarn storage 9 and for winding up the yarn 5 which is again drawn from the yarn storage 9 may, in principle, be selected as desired on condition that the yarn section which is stored temporarily and is later made available in form of parallel yarn windings 51 is at least of equal length as the yarn segment which must be fed back to the spinning element 10 for the actual piecing. The times selected must not be too close, as the tolerances change with different package configurations and fiber materials. In addition the unwinding speed into the yarn storage 9 and the winding speed from the yarn storage 9 play, of course, a considerable role. If the two speeds are identical, identical times may be selected. The speed at which the cross-wound package is driven must also be taken into consideration in determining the overall yarn length to be put in temporary storage. If desired, the times for winding and unwinding the yarn can also be calculated by means of a computer. Because of the changing diameter ratio with conical cross-wound packages between the small and the large diameter of the cross-wound package 42, the actual mean diameter also plays a considerable role which is therefore essential in determining the times.

To avoid having to provide for possibly automatic adjustment changes as operating conditions change, the times may be selected so that they are sufficiently long whatever the conditions may be at any time, so that they cover all possibilities. This is the case when the times are selected in function of the maximum possible driving speed of the cross-wound package 42 and also of the smallest possible diameter of a conical cross-wound package 42.

It goes without saying that the times should also be selected of sufficient length so that when the fiber collection surfaces of the spinning elements 10 are used in different sizes, e.g. spinning rotors of different sizes are used, the longest possible yarn back-feeding segment is made available. The back-feeding length for piecing must then be adapted to the applicable fiber collection surface in a known manner.

To make it possible for the length of yarn to be fed back for piecing to be determined easily, without conversions in the control device 23, the embodiment shown provides for the auxiliary drive roller 72 which can be applied externally to the cross-wound package 42 to drive said cross-wound package 42 at a point along its width where the parallel yarn windings 51 are also produced. This means that the yarn guide (circumferential groove 83 of the centering device and auxiliary driving roller 72) must be in the same plane which is perpendicular to the axis of the package. From the description above it can be seen that such an arrangement is not necessary if conversion calculations resulting from different diameters are acceptable.

As the description above shows, the embodiment described and the described process can be varied in many ways, e.g. by replacing individual characteristics by equivalents or by other combinations thereof. It is thus not necessary, for instance, for the cross-wound package 42 to be driven at its perimeter; it is also possible to provide an individual drive for the cross-wound package 42 which drives the cross-wound package 42 internally, via the former. In this case the monitoring of the diameter of the cross-wound package 42 is especially important, as the circumference, and thereby the conveyed yarn length, change considerably as the diameter of the package increases.

In the embodiment shown the yarn delivery device is pneumatic and its main component is therefore the suction pipe 20. However, a mechanical yarn delivery device could also be used, e.g. in form of a feeder and a pair of rollers, possibly working with slippage, which cause the stretching of the yarn 5. Also a compensating hoop acting upon the yarn at a right angle to the course of said yarn, between the clamping device and a mechanical yarn delivery device, could be used.

The pneumatic yarn storage 9 can also be designed in different manners, and it is absolutely possible for it to be controlled together with the underpressure in the suction pipe 20. To save air and energy however, the yarn storage 9 can also be assigned (as described earlier) a separate valve 90 for control, in particular to switch the underpressure in the yarn storage 9 on and off. In order to also avoid the mechanical retention effect at its outlet, provisions can be made, as shown in FIG. 1, for the yarn storage 9 to extend essentially in continuation of the course of the yarn 5 extending away from the side away from the clamping device 6, i.e. of the yarn 5 extending from the package 42 or the centering device 8 to the yarn storage 9.

The yarn guide which was described earlier as a circumferential groove 83 of a centering spindle 8 can also be designed in different ways, e.g. in form of a traversing, self-threading yarn guide capable of being moved parallel to the generating line of the cross-wound package 42 to receive the yarn 5 and which can finally be stopped at the desired location to guide the yarn 5. As an alternative, it is also possible to provide two pins extending parallel with each other and at a right angle to the package axis and to the course of the yarn, one of these pins being located on one side and the other on the other side of the yarn 5, these pins being moved towards each other in such manner that they enclose the yarn 5 between them and thereby position it in the desired position.

A clamping device in form of a pair of rollers (auxiliary roller pair 6) is especially advantageous, but if desired it is also possible to provide a clamping device with clamping jaws of a different design. Such a clamping device with two clamping jaws not in form of a pair of rollers can, for example, be swivelled first across the outlet of the yarn draw-off pipe 11 for the introduction of the yarn end being fed back into the open-end spinning device, until the yarn end is located above the outlet and is sucked into the yarn draw-off pipe 11 as the clamping device moves back slowly into a position above this outlet. The clamping action of the clamping device is then terminated in order to release the yarn 5 for further back-feeding, i.e. back-feeding for piecing.

What is claimed is:

1. A process of preparing a predetermined length yarn for piecing after the occurrence of a break in the yarn during the spinning of yarn in the spinning rotor of an open-end spinning machine where the yarn produced by said spinning rotor is wound onto a cross-wound package, comprising the following steps:

(a) grasping the end of said broken yarn adjacent to said cross-wound package;
(b) first backfeeding said yarn from said package;
(c) clamping said backfed yarn end at a predetermined clamping point while continuing to backfeed said yarn;
(d) temporarily storing said backfed yarn in a temporary storage device between said clamping point and said cross-wound package;
(e) interrupting said backfeeding of said yarn;
(f) winding a plurality of parallel windings of yarn drawn from said temporary storage device on a predetermined line on said package;
(g) unclamping said yarn and stretching said yarn from said package to remove any yarn remaining in said temporary storage device;
(h) reclamping said stretched yarn;
(i) cutting said yarn adjacent to said clamping point;
(j) transferring said clamped yarn end into a withdrawal tube of said spinning rotor;
(k) backfeeding said yarn a second time to unwind said parallel windings to remove a length of yarn for piecing with fibers in said spinning rotor;
(l) piecing said yarn with said fibers in said spinning rotor, and
(m) withdrawing said pieced yarn from said spinning rotor.

2. A process for piecing a yarn end as set forth in claim 1, including the step of backfeeding said yarn a second time which is equal to the time said yarn was parallel wound onto said package.

3. A process for piecing an end of yarn on an open-end spinning device wherein a broken yarn is detected and said open-end spinning device is stopped and cross-winding of the yarn on a cross-wound package is interrupted, comprising the following steps:

(a) locating and grasping the end of said yarn which is wound on said cross-wound package;
(l) backfeeding a third predetermined length of yarn from said plurality of parallel windings into said open-end spinning device;
(m) beginning of feeding fibers into said open-end spinning device for binding said fibers into the end of said backfed yarn length; and
(n) withdrawing again said yarn out of said open-end spinning device while continuously binding-in said continuously fed fibers.

4. A process for piecing an end of yarn as set forth in claim 3, including the step of driving said cross-wound package for a period of time which is not greater than the period of time said yarn was backfed after said yarn was initially clamped for forming said parallel windings of said yarn.

5. A process for piecing an end of yarn as set forth in claim 3, wherein the step of driving said cross-wound package continues for a period of time which is equal to the period of time said yarn was back fed after said yarn was initially clamped for forming said parallel windings of said yarn.

6. A process for piecing a yarn end as set forth in claim 3, including the step of adjusting the times for said backfeeding said yarn relative to the winding speed of said cross-wound package.

7. A process for piecing a yarn end as set forth in claim 3, wherein the step of considering the mean diameter of said cross-wound package in determining the times for the backfeeding of said yarn after the clamping of said yarn.

8. A process for piecing a yarn end as set forth in claim 3, including the step of determining said backwinding times as a function of the maximum possible driving speed of the cross-wound package.

9. A process for piecing a yarn end as set forth in claim 3, including the step of determining said backwinding times as a function of the minimum possible means diameter of a conical cross-wound package.

10. A process for piecing a yarn end as set forth in claim 3, including the step of adjusting the time of backfeeding said yarn after clamping of the yarn is longer than the length of the yarn backfed to said open-end spinning device.

11. A process for piecing a yarn end as set forth in claim 3, including the step of winding said parallel windings at the point where said cross-wound package is driven.

12. An open-end spinning apparatus for spinning yarn from fibers, having means for piecing up yarn ends, comprising:

(a) an open-end spinning element for spinning yarn from fibers;
(b) a yarn draw-off tube for taking yarn off said spinning element;
(c) a yarn winding device for winding said yarn onto a cross-wound package;
(d) a controlled driving device for driving said winding device;
(e) a backdelivery device for backfeeding yarn from said package;
(f) a yarn delivery device spaced a predetermined distance from said winding device;
(g) yarn clamping means disposed between said winding device and said yarn delivery device for selectively clamping said yarn;
(h) a cutting device disposed between said clamping means and said delivery device for cutting said yarn;
(i) a yarn guide disposed between said clamping device and said winding device for selectively guiding said yarn onto said package;
(j) a temporary storage device disposed in the path of said yarn between said clamping means and said winding means;
(k) control means for said driving means for driving said package to backfeed said yarn initially for a predetermined period of time for storing a predetermined length of said yarn in said temporary storage device and for subsequently winding said yarn from said storage device in parallel windings on a predetermined line on said package and for opening said clamping means to permit said delivery means to draw any yarn remaining in said temporary storage device and for closing said clamping means after said yarn is tensioned between said package and said delivery means;
(l) means for operating said cutting means to cut said yarn between said clamping means and said delivery means after it is tensioned; and
(m) means for moving said clamped yarn to said yarn withdrawal tube and for backfeeding said cut end of said yarn from said parallel windings through said tube to said spinning element for piecing up said yarn.

13. An open-end spinning apparatus as set forth in claim 12, wherein said temporary yarn storage device extends away from said yarn path and said clamping means.

14. An open-end spinning apparatus as set forth in claim 12, wherein said driving device comprises a driving element for contacting the outer perimeter of said cross-wound package.

15. An open-end spinning apparatus as set forth in claim 14, wherein said yarn guide is positioned adjacent said cross-wound package to guide said parallel windings onto said cross-wound package in the area where said driving element contacts said outer perimeter of said package.

16. An open-end spinning apparatus as set forth in claim 12, wherein said yarn guide comprises a threaded spindle capable of being selectively driven in opposite directions of rotation.

17. An open-end spinning apparatus as set forth in claim 16, wherein said spindle has two longitudinal sections of different diameters with opposite thread pitches and a circumferential groove at the point of transition between said longitudinal sections for guiding said yarn.

18. An open-end spinning apparatus as set forth in claim 12, wherein said control means comprises a timing element for said driving means for said winding device to backwind said yarn and to rewind said yarn an equal period of time.

19. An open-end spinning apparatus as set forth in claim 12, wherein said control means includes means for controlling the speed of said driving device.

20. An open-end spinning apparatus as set forth in claim 12, wherein said control means is connected to a detecting device for determining the mean diameter of cross-wound conical package present in said winding device.

21. An open-end spinning apparatus as set forth in claim 12, wherein said clamping means comprises a pair of rollers.

22. An open-end spinning apparatus as set forth in claim 12, wherein said rollers which are openable to receive said yarn and closeable to clamp said yarn.

23. An open-end spinning apparatus as set forth in claim 12, wherein said clamping rollers are moved to bring said backfed yarn into said yarn withdrawal tube.

24. An open-end spinning apparatus as set forth in claim 12, wherein said yarn delivery device backfeeds said yarn pneumatically.

* * * * *